US006247864B1

(12) United States Patent
Walsh

(10) Patent No.: US 6,247,864 B1
(45) Date of Patent: Jun. 19, 2001

(54) PAPER DISPENSING NOTE PEN

(76) Inventor: Daniel M. Walsh, 2005 Pinto La., Las Vegas, NV (US) 89106

( * ) Notice: Subject to any disclaimer, the term of this patent is extended or adjusted under 35 U.S.C. 154(b) by 0 days.

(21) Appl. No.: 09/495,335

(22) Filed: Feb. 1, 2000

(51) Int. Cl.[7] ..... B43K 29/00
(52) U.S. Cl. ..... 401/195; 401/52
(58) Field of Search ..... 401/52, 195

(56) References Cited

U.S. PATENT DOCUMENTS 4,872,775 * 10/1989 Chang ..... 401/52
4,989,801 * 2/1991 Thomas et al. ..... 242/55.53

FOREIGN PATENT DOCUMENTS

1043580 * 6/1953 (FR) ..... 401/195
88/01574 * 3/1988 (WO) ..... 401/195

* cited by examiner

*Primary Examiner*—Gregory L. Huson
*Assistant Examiner*—Tuan Nguyen
(74) *Attorney, Agent, or Firm*—David A. Lingbeck

(57) ABSTRACT

A paper dispensing note pen includes an elongate spool support member having a threaded back end and a bore therethrough and further includes a conical nose piece and an endcap which is removably threaded on the back end of the elongate spool support member, and also includes a tubular casing having an open back end and a longitudinal slot extending through the side of the casing and being adapted to receive sheets of paper therethrough and being removably engaged to the nose piece and to the endcap, and further includes a spool having a bore extending therethrough and being adapted to rotatably mount about the elongate spool support member and being removably disposed inside the casing and also includes a plurality of sheets of paper formed into a roll about the spool, and a cap member for removably closing about the writing tip.

13 Claims, 4 Drawing Sheets

PAPER DISPENSING NOTE PEN

BACKGROUND OF THE INVENTION

This invention relates to a paper dispensing note pen which has individual pieces of recycled paper wrapped about a spool.

Everybody at one time or another use ink pens and even pieces of paper upon which information is jotted thereupon as either a reminder to themselves or information for somebody else. There are many different types of ink pens and even pencils including different types of note pads used by people. Unfortunately, most people may remember to carry a pen with them but often forget to carry a note pad especially when they need it most. Recently some ink pens come with note paper so that the user does not have to carry separate items.

One known prior art is a NOTE PAPER-HOLDING PEN, U.S. Pat. No. 4,872,775, which includes a roll of writing paper wound about a spool which is rotatably disposed inside of the pen casing carrying the ink cartridge with the casing having a longitudinal slot through which the paper is dispensed with the longitudinal slot having a cutting edge upon which a selected amount of paper is severed from the roll. The ink cartridge is retractable inside the pen casing.

Another known prior art is a NOTE PEN DEVICE, U.S. Pat. No. 4,963,048, which includes a roll of writing paper wound about a spool which is rotatably disposed inside of the pen casing and further includes a spool turning member by which the user moves to turn the spool a selected distance to let out a selected amount of writing paper.

None of the prior art discloses a disposable paper note pen of the present invention which is quite inexpensive and affordable for everybody.

SUMMARY OF THE INVENTION

This invention relates to a paper dispensing note pen which comprises a conical nose piece, an elongate tubular casing having a front end and a back end and also having a longitudinal slot extending through a side of the casing, and further comprises an elongate spool support member having a bore extending therethrough and having a threaded back end to which an endcap is removably threaded, and also comprises a spool rotatably and removably mounted about the spool support member and disposed within the casing, and further comprises a plurality of pieces of paper each having an adhesive strip on a back side thereof and being formed in a roll about the spool, and also comprises a writing tip cap.

One objective of the present invention is to provide a paper dispensing note pen which is easy for the user to quickly remove and replace a spool carrying a roll of pieces of paper.

Another objective of the present invention is to provide a paper dispensing note pen which is essentially made of recycled paper.

Also, another objective of the present invention is to provide a paper dispensing note pen which has a plurality of pieces of paper having adhesive and being formed into a roll for being able to attach to any surface.

Yet, another objective of the present invention is to provide a paper dispensing note pen which is usable with or without a spool.

Further objectives and advantages of the present invention will become apparent as the description proceeds and when taken in conjunction with the accompanying drawings wherein:

DETAILED DESCRIPTION OF THE INVENTION

Figure 1:
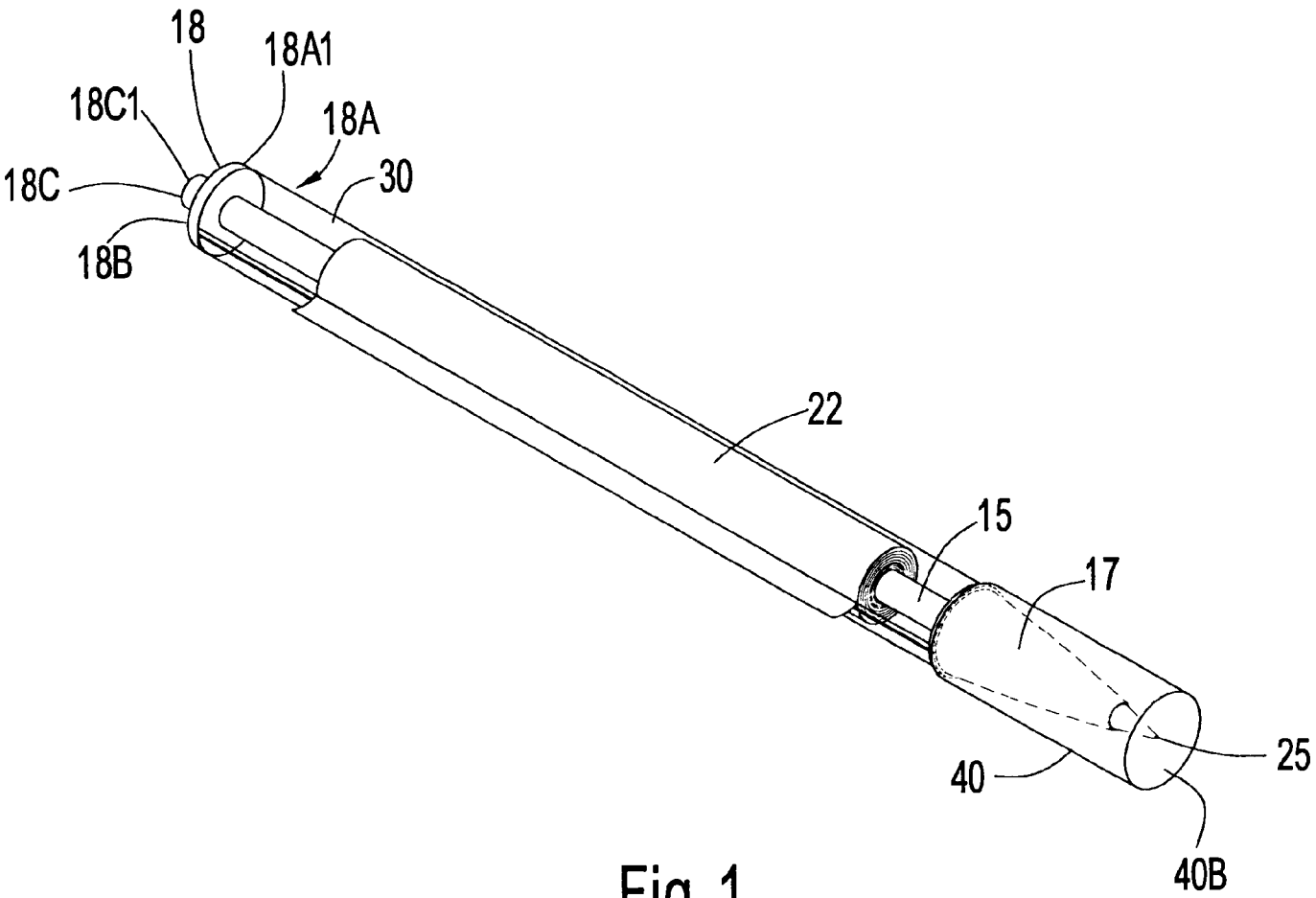
FIG. 1 is a perspective view of the paper dispensing note pen.
Figure 2:
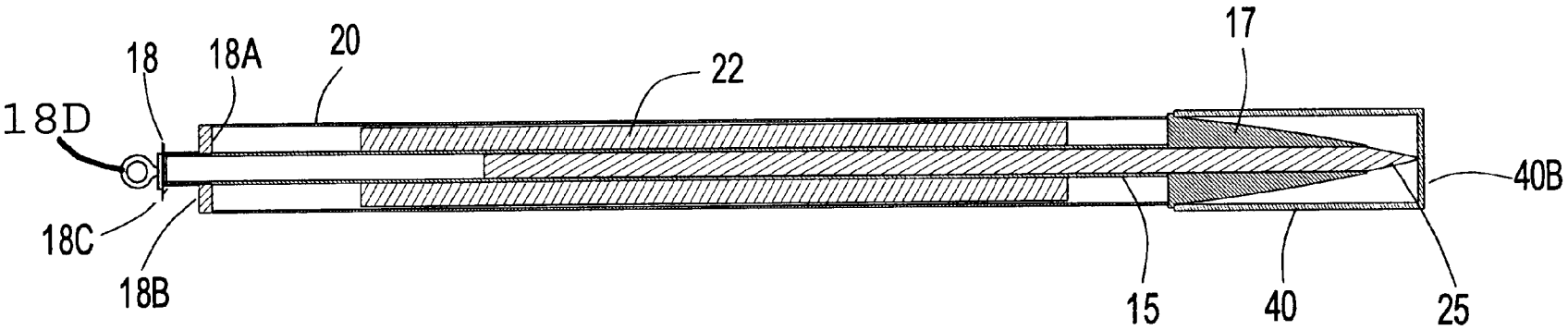
FIG. 2 is a cross-sectional side view of the paper dispensing note pen.
Figure 3:
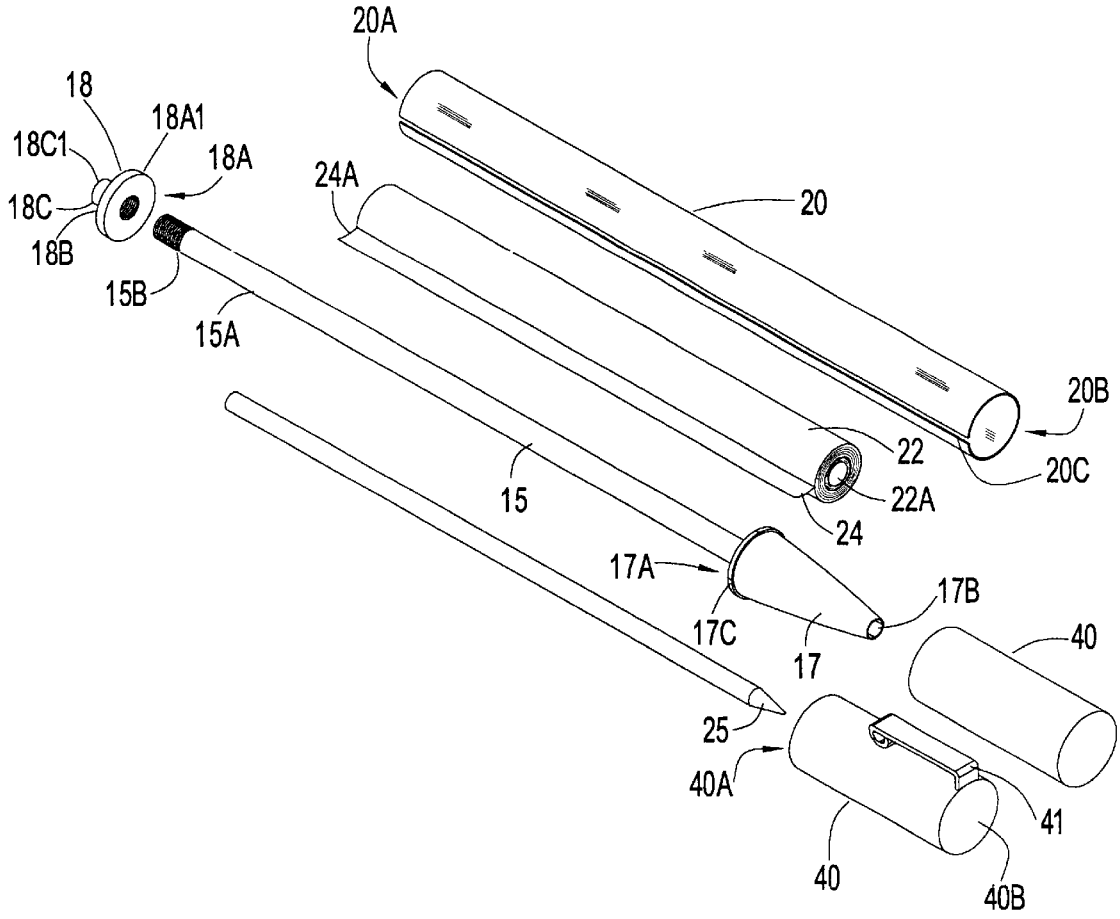
FIG. 3 is an exploded perspective view of the paper dispensing note pen displaying two embodiments thereof.
Figure 4:
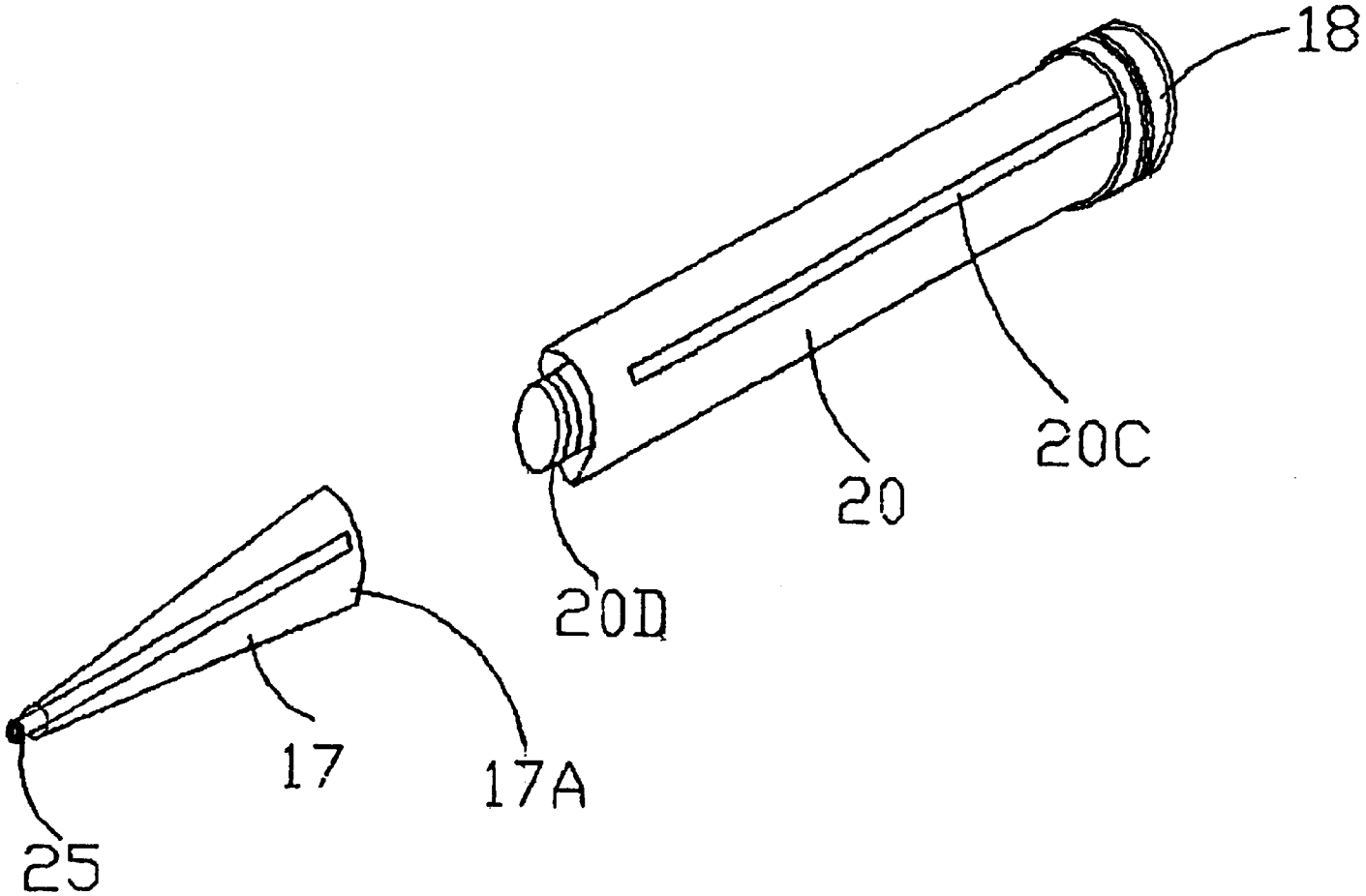
FIG. 4 is an exploded perspective view of another embodiment of the dispensing note pen.

According to the drawings in FIGS. 1–4, in particular, the paper dispensing note pen comprises an elongate spool support member 15 having a bore 15A extending therethrough and having a threaded back end 15B, and further comprises a tubular casing 20 having an open back end 20A and an open front end 20B and also having a longitudinal slot 20C extending the length of and through a side wall of the casing 20. The paper dispensing note pen further comprises a conical nose piece 17 having an open back end 17A and an opening through the front end 17B, the opening being adapted to receive the writing portion of the ink cartridge 25 which is removably disposed in the elongate spool support member 15 through the open back end 15B thereof. In addition, the paper dispensing note pen also includes a spool 22 having a bore 22A extending therethrough and being adapted to be removably and rotatably disposed within the casing 20 with either the open front end 20B or open back end 20A of the casing 20 being adapted to receive the spool 22 therethrough, and also being adapted to rotatably mount about the elongate spool support member 15 which extends through the bore 22A of the spool 22 which is used to carry a plurality of pieces of paper 24 each having a strip 24A of adhesive on a backside and near an end thereof. The plurality of pieces of paper 24 are formed into a roll 24 about the spool 22 with the pieces of paper being rolled about one another for easy dispensing. Once placed inside the casing 20, the spool 22 is held therein with the nose piece 17 and with an endcap 18 having an open front end 18A and a closed back end 18B with a hollow projecting portion 18C centrally extending outwardly therefrom and having a closed end and an open end with a threaded longitudinal bore 18C1 extending in the projecting portion 18C which is adapted to receive the threaded back end 15B of the elongate spool support member 15. An eyelet member 18D is securely and conventionally attached to the hollow projecting portion 18C to allow the user to loop a string or some other elongate flexible member through the eyelet member 18D to be able to suspend the note pen to some other object. Both the open front end 18A of the endcap 18 and the open back end 17A of the nose piece 17 have rims 17C,18A1 which are adapted to engage about the ends 20A–B of the casing 20 to essentially hold the paper dispensing note pen together and to securely retain the spool 22 and the ink cartridge 25 inside the casing 20 The ink cartridge 25 is removably disposed inside the casing 20 and extends through the bore 15A of the elongate spool support member 15 with the writing tip being exposed through the front end 17B of the nose piece 17. When not being used, the writing tip is covered with a conventional cap member 40 having an open end 40A and a closed end 40B and being removably engaged about the nose piece 17 at the front end 17B thereof.

To use the paper dispensing note pen, the user places the spool 22 carrying a roll 24 of plurality of pieces or sheets of paper through either the front end 20B or the back end 20A of the casing 20 and rotatably about the elongate spool support member 15, and extends the ink cartridge 25 through the open back end 15B and through the bore 15A of the elongate spool support member 15 with the writing tip being exposed at the front end 17B of the nose piece 17, and threads the endcap 18 onto the back end 15B of the elongate spool support member 15 and engages the rim 18A1 of the endcap 18 about the back end 20A of the casing 20 and engages the rim 17C of the nose piece 17 about the front end 20B of the casing 20 and extends the outermost sheet of note paper 24 from the roll through the longitudinal slot 20C in the casing 20 to make the paper accessible to the user. The sheets of note paper do not need to be ripped or cut off from the roll 24, because each sheet is attached to the immediate underlying sheet with the adhesive strip 24A disposed on the backside thereof. The user unwinds or unrolls the outermost sheet of paper from the spool 22 through the longitudinal slot 20C in the casing 20 and also removes the cap member 40 so that the user can write upon the selected sheet of paper as desired. After finishing, the user replaces the cap member 40 over the front end of the nose piece 17 and writing tip, and adheres the sheet of paper to the desired surface. As an alternate embodiment, the cap member 40 includes a pocket clip 41 with an elongated member having an end fixedly attached with conventional means to the cap member 40 and extending longitudinally of the cylindrical cap member 40 to allow the user to place and clip the paper dispensing note pen in one's pocket for safekeeping with the pocket being disposed between the pocket clip 41 and the cylindrical cap member 40.

After all the sheets are removed from the spool 22, the user can easily replace the spool 22 with a refill roll 24 by simply disengaging the endcap 18 from the back end 20A of the casing 20 and unscrewing the endcap 18 off the elongate spool support member 15 and sliding the spool 22 off the elongate spool support member 15 and out the back end 20A of the casing 20 and placing a new roll 24 of sheets of paper carried about a spool 22 about the elongate spool support member 15 and through the back end 20A of the casing 20 with the endcap 18 being threaded onto the elongate spool support member 15 and being engaged about the back end 20A of the casing 20 and engaging the nose piece 17 about the front end 20B of the casing 20.

As an alternate embodiment, the paper dispensing note pen includes an elongate nose piece 17 having an open front end 25 and an open back end 17A and having a bore extending therethrough from the front end to the back end and also having a conical front portion and being threaded on the inner side of the wall of the nose piece 17 at the back end 17A thereof. The paper dispensing note pen also includes an elongate housing 20 having an open front end, an open back end, a longituidnal slot 20C extending through a side of the housing 20 and extending from near the front end to the back end and being dimensioned to receive a sheet of note paper therethrough, and further having an annular recessed portion 20D at the front end of the housing 20, the recessed portion 20D being threaded on the exterior thereof and being adapted to be threadingly received through the back end 17A of the nose piece 17. The housing 20 is adapted to receive and house a roll of individual sheets of note paper which is placed inside the housing 20 through the open back end. Once the roll of note paper is inserted into the housing, the back end is closed with an endcap 18 which is removably engaged in the back end of the housing 20. For use, the housing is threaded to the nose piece and the end of the outermost sheet on the roll is extended through the longitudinal slot within reach of the user. An optional nose cap can be used to removably cover the writing tip of the ink cartridge which is securely and conventionally disposed in the bore of the nose piece with the writing tip being exposed through the front end of the nose piece.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A paper dispensing note pen comprising:

an elongate spool support member having a bore extending therethrough and having a threaded back end;

a nose piece having an open back end;

a casing having an open back end and an open front end and further having a longitudinal slot extending through a side wall thereof, said nose piece being removably engaged about said casing;

an ink cartridge having a writing tip and being removably disposed in said bore of said elongate spool support member;

a spool having a first end, a second end and a bore extending therethrough, said spool being rotatably mounted about said elongate spool support member and being removably disposed within said casing;

a plurality of sheets of paper formed into a roll about said spool;

an endcap being removably threaded to said elongate spool support member and being removably engaged about said casing; and a cap member for removably covering said writing tip.

2. A paper dispensing note pen as described in claim 1, wherein said nose piece has an open back end having a rim for removably engaging about said front end of said casing.

3. A paper dispensing note pen as described in claim 2, wherein said nose piece is essentially conically shaped with an opening through a front end thereof.

4. A paper dispensing note pen as described in claim 2, wherein said longitudinal slot of said casing is adapted to receive said plurality of sheets of paper therethrough.

5. A paper dispensing note pen as described in claim 4, wherein said endcap has an open front end having a rim for removably engaging about said back end of said casing.

6. A paper dispensing note pen as described in claim 5, wherein said endcap further includes a back end having a projecting portion centrally extending outwardly therefrom.

7. A paper dispensing note pen as described in claim 6, wherein said projecting portion has an open end and a closed end.

8. A paper dispensing note pen as described in claim 7, wherein said projecting portion has a threaded bore therein for threading upon said threaded back end of said elongate spool support member.

9. A paper dispsensing note pen as described in claim 8, wherein said endcap further includes an eyelet securely attached thereto for being able to suspend said note pen to an object.

10. A paper dispensing note pen as described in claim 1, wherein said bore of said spool is adapted to receive said ink cartridge therethrough.

11. A paper dispensing note pen as described in claim 10, wherein each of said sheets of paper has an adhesive strip on a back side thereof for securing to a surface.

12. A paper dispensing note pen as described in claim 11, wherein said plurality of sheets of note paper are recycled.

13. A paper dispensing note pen as described in claim 1, wherein said cap member further includes a pocket clip which has an end attached to said cap member and extends longitudinal of said cap member for securing said paper dispensing note pen to a user's pocket.

* * * * *